United States Patent [19]

Finn, deceased et al.

[11] 3,997,136

[45] Dec. 14, 1976

[54] TOY-KITE AIRPLANE

[76] Inventor: Alfred C. Finn, deceased, late of Tustin, Calif., by Lucretta M. Finn, surviving spouse, 17261 Irvine Blvd., Suite 101, Tustin, Calif. 92680

[22] Filed: Jan. 2, 1975

[21] Appl. No.: 537,914

[52] U.S. Cl. ..... 244/153 A; 46/77; 244/154

[51] Int. Cl.[2] ..... B64C 31/06

[58] Field of Search ..... 244/9, 10, 19, 21, 39, 244/153 R, 153 A, 154, 155 R, 155 A; 46/76 R, 77, 79

[56] References Cited

UNITED STATES PATENTS

| | | | |
|---|---|---|---|
| 2,593,979 | 4/1952 | Calhoun | 244/153 A X |
| 2,801,063 | 7/1957 | O'Gorman | 244/154 |
| 2,827,252 | 3/1958 | Pohl | 244/154 |
| 3,107,888 | 10/1963 | Finn | 244/154 |
| 3,727,864 | 4/1973 | Tolomizenko | 244/154 |

*Primary Examiner*—Trygve M. Blix
*Assistant Examiner*—Galen L. Barefoot

[57] ABSTRACT

An airplane-like kite toy, which is designed to simulate an airplane in appearance and in flight characteristics, the toy having rotatable wings detachably mounted to a fuselage body in a novel manner wherein the wings are fixedly secured to a shaft, the shaft being rotatably supported by a support member in the form of a yoke structure. The yoke structure includes bearings in which the shaft is rotatably locked and positioned therein, the entire wing structure being detachably secured to the fuselage body, wherein the fuselage body and the wings are of a solid monolithic construction. Disc-like members are carried at opposite ends of the wings for serving as landing-gears, flight-stabilizers, and protective members, the disc-like members thus rotate with the wings. Positioned forwardly of the support member and removably disposed in the fuselage body is a tether line, whereby the tether line is attached thereto to provide for controlling the flight of the airplane-like kite.

8 Claims, 6 Drawing Figures

TOY-KITE AIRPLANE

BACKGROUND

1. Field of the Invention

This invention relates generally to a kite whichh simulates an airplane in appearance and in flight characteristics --- particularly in take-off, in the air, and in landing; and, more particularly, the invention relates to a novel means by which the wing means thereof is demountably supported and secured to thee fuselage body of the kite structure.

2. Description of the Prior Art

Prior proposed kite constructions have employed rotatable wings, such as U.S. Pat. Nos. 2,593,979 and 3,107,888; however, such prior proposed kite constructions known to the applicants have various problems and difficulties in construction and assembly thereof. Hence, the above references are relatively complicated, expensive to manufacture, and have an inherent short-life span off operation.

These types of toy kites are generally operated and flown by young children; therefore, certain requirements should be met — these including sufficient strength to take abusive handling, and a simple but rugged demountable means whereby a person of any age can assemble or readily take apart the unit without the use of tools or fear of breaking the components thereof.

Referring particularly to U.S. Pat. No. 3,107,888, the inventor thereof being one of the applicants in the present invention, it has been found that the mounting and supporting means as incorporated therein do not provide the most efficient means of construction, or the operation thereof. In addition thereto, the fuselage body member is constructed of a thin plastic material forming a hollow tubular body from the leading nose portion throughout to the trailing elevator section. This does provide a lightweight construction; however, it is inherently exposed to damage by careless handling thereof or when flown in adverse wind conditions.

Accordingly, the present invention which is hereinafter described in detail will provide the necessary elements and construction whereby the above problems are solved.

SUMMARY

The present invention relates to a toy kite having the appearance of an aircraft with various flight characteristics thereof. Accordingly, the airplane-like kite structure comprises a fuselage formed as a solid monolithic body composed of very-durable, extremely-lightweight, plastic material of the polystyrene class, together with wing means that are operably supported to the fuselage in the normal transverse manner. Again, the wing member of the wing means is also formed as a solid monolithic member adapted to fixedly receive a rotatable shaft which extends equally from the opposite sides of the fuselage body.

The fuselage body is provided with a transverse recess channel positioned about the mid-point of the fuselage, whereby a support means is adapted to be received therein and demountably secured to the fuselage, the support means including a means for detachably securing the entire wing structure to the fuselage.

In addition, the support means includes bearing means wherein the shaft secured to the wing members is rotatably received and held in position by a retaining means in the form of a retaining ring disposed intermediate the bearing means. Disc-like members are arranged to be force fitted on opposite ends of each wing member, thereby providing a landing-gear means, as well as a flight-stabilizing means and protection means.

OBJECTS AND ADVANTAGES

The present invention has for an important object a provision for a novel and unique demountable support and mounting means, whereby the wing means can be readily mounted and operably supported to the fuselage body of the kite-like airplane.

Another object of the invention is to design and provide a kite construction utilizing a monolithic method comprising a very lightweight but dense plastic material that is easily molded into shape, providing a structurally rigid yet very lightweight fuselage, wing and landing gear members.

It is another object of the present invention to provide an airplane-like kite wherein the wing members are fixedly secured to a rotatable shaft supported by a unique support means, said support means including bearing means, a restraining means for transversely positioning the wing means, and a means for detachably securing the wing means to the fuselage body, all of said means being incorporated into a single yoke member.

It is still another object of the invention to provide a toy of this character that includes a simple means for securing a tether line to the fuselage for a controlled flight thereof.

It is a further object of the invention to provide a toy of this character that is relatively simple to construct and inexpensive to manufacture.

A still further object of the invention is to provide an airplane-like kite having a relatively-long working life.

Other characteristics, advantages and objects of this invention can be more readily appreciated from the following description and appended claims. When taken in conjunction with the accompanying drawings, this description forms a part of the specification wherein like references and characters designate corresponding parts in several views.

DESCRIPTION OF THE DRAWINGS

Referring more particularly to the accompanying drawings, which are for illustrative purposes only.

DESCRIPTION OF THE PREFERRED EMBODIMENT

Figure 1:
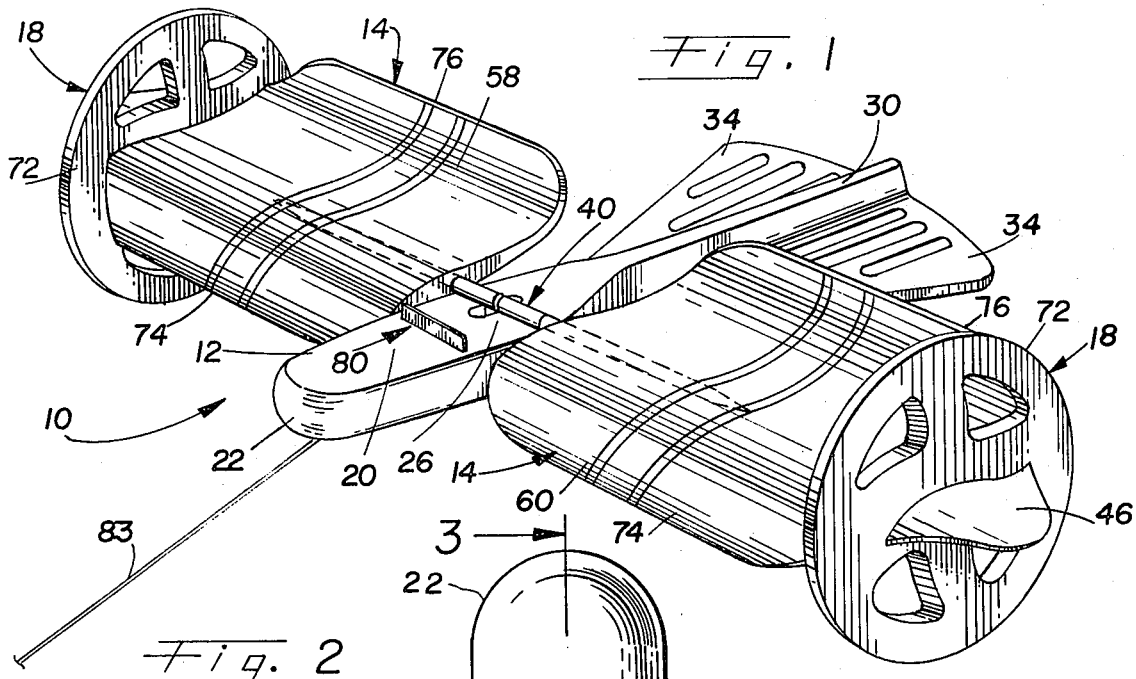
FIG. 1 is a perspective view of the airplane-like kite having a tether line attached thereto.

Referring to the drawings and more particularly to FIG. 1, the present invention is illustrated as an airplane-like-kite toy, generally indicated at 10, having the general characteristics and features embodying an aircraft, especially those of an airplane. The kite-like device 10 comprises a fuselage means 12 and a wing means 14 operably attached to said fuselage, said fuselage being provided with a unique demountable support means, indicated generally at 16. The kite 10 also includes stabilizng, landing and protective means 18 provided adjacent each end of the wing means 14.

Figure 3:
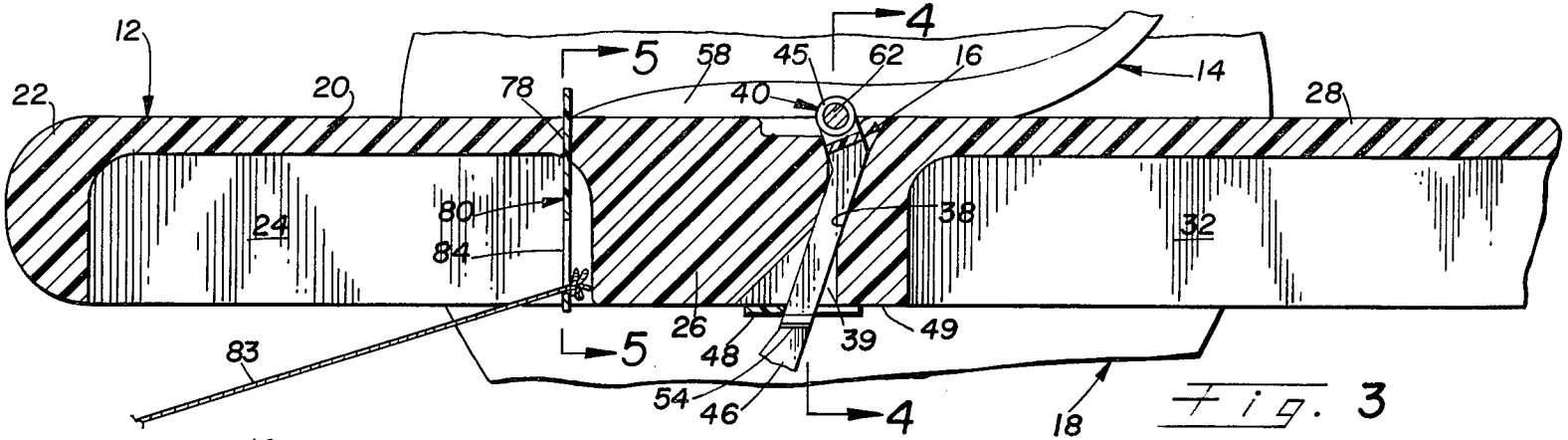
FIG. 3 is a cross-sectional view taken approximately along line 3—3 of FIG. 2.
Figure 5:
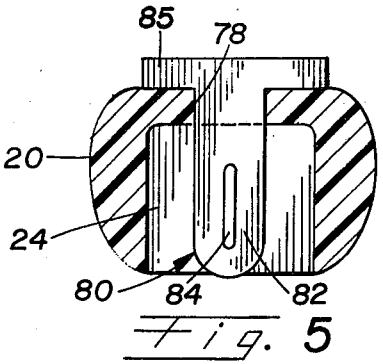
FIG. 5 is a cross-sectional view taken along line 5—5 of FIG. 3, illustrating the tether-connecting means as received and supported in the fuselage body.
Figure 4:
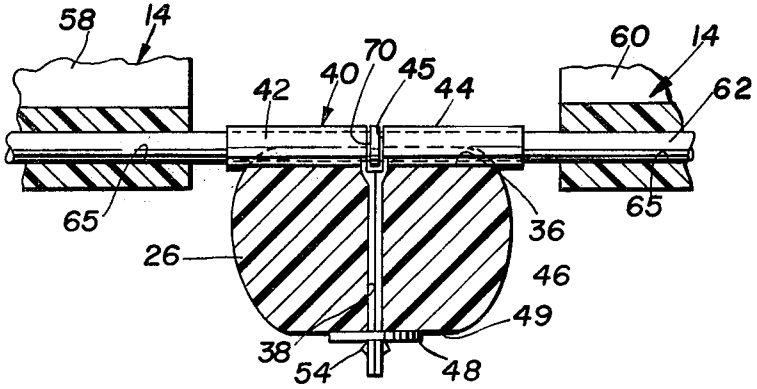
FIG. 4 is a cross-sectional view taken approximately along line 4—4 of FIG. 3, wherein the yoke member is shown locked into the fuselage, thus providing a positive support means for the wing means and shaft thereof.

It is contemplated that the fuselage means 12 will be constructed of suitable lightweight plastic and synthetic materials capable of being formed into a somewhat-solid monolithic body, as can be seen in the cross-sectional views of FIGS. 3, 4 and 5. Hence, the fuselage means 12 is defined by a forward main-body portion 20, including the nose portion 22. Just following said nose portion 22, there is formed a recess area 24 whereby excess material is eliminated to provide a very lightweight but rigid structure. However, the remaining solid-mass formation, as indicated at 26, forms the support area to which said demountable support means 16 is secured.

The trailing portion of the fuselage means — that is, the integral adjacent portion 28 rearward of the area 26 — is gradually tapered longitudinally to form the typical, suitably-shaped, elongated, tail fin 30. Here, also, there is formed an elongated recess 32, eliminating unnecessary weight. Extending from the opposite sides of the rear fuselage body is an integrally-formed and suitably-shaped elevator section 34. Hence, the overall structure of the fuselage means 12 has the appearance of a streamlined fuselage body such as those constructed for high-speed-jet aircraft.

Recessed within the upper surface of the fuselage and integrally formed with the solid-mass formation 26, there is provided a transverse channel 36 which communicates with a vertical slit 38 that extends downwardly through area 26, terminating with a lower opening 39.

The channel 36 is recessed deeply enough to firmly receive and retain the support means 16 which comprises a substantially T-shaped yoke means, as seen in FIG. 4. This yoke means is so designed as to incorporate a bearing means 40 and a means for detachably securing the yoke means, along with the entire wing structure, to the fuselage body 12. These various mentioned means will be described in detail in the following description.

Figure 6:
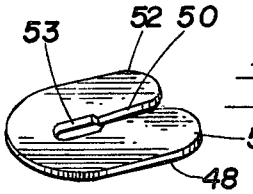
FIG. 6 is a perspective view of the locking tab used to lock the yoke member to the fuselage body.

Accordingly, the bearing means 40 and said detachable securing means are formed as an integral unit wherein the bearing means comprises oppositely-disposed sleeve members 42 and 44 having a slotted opening 45 therebetween. The bearings, along with the entire yoke member, may be composed of any suitable material; but it is contemplated that a suitable plastic material capable of supporting a load force will be used. Integrally formed and depending downwardly at a slight angle, there is a leg member 46 which is adapted to be received in slit 36 of the solid-body area 26. (See FIGS. 3 and 4.) Said leg 46 is part of the detachable securing means which includes a locking tab or plate 48, clearly illustrated in FIG. 6.

When the yoke is positioned in channel 36 and leg 46 extends through slit 38, the leg 46 protrudes outwardly beyond the lower wall 49 of the fuselage body. To secure the yoke in place in a positive manner, locking plate 48 is designed to snap over the extended portion of leg 46, said locking plate being provided with a central slot 50, forming oppositely-disposed resilient ears 52, whereby the plate is forced over the leg 46 — the width of the slot 50 being smaller than the thickness of the leg — at which point the leg is received in the larger opening 53 of the locking plate 48. The locking plate is held firmly against the lower wall 49 by means of projecting fins 54.

Figure 2:
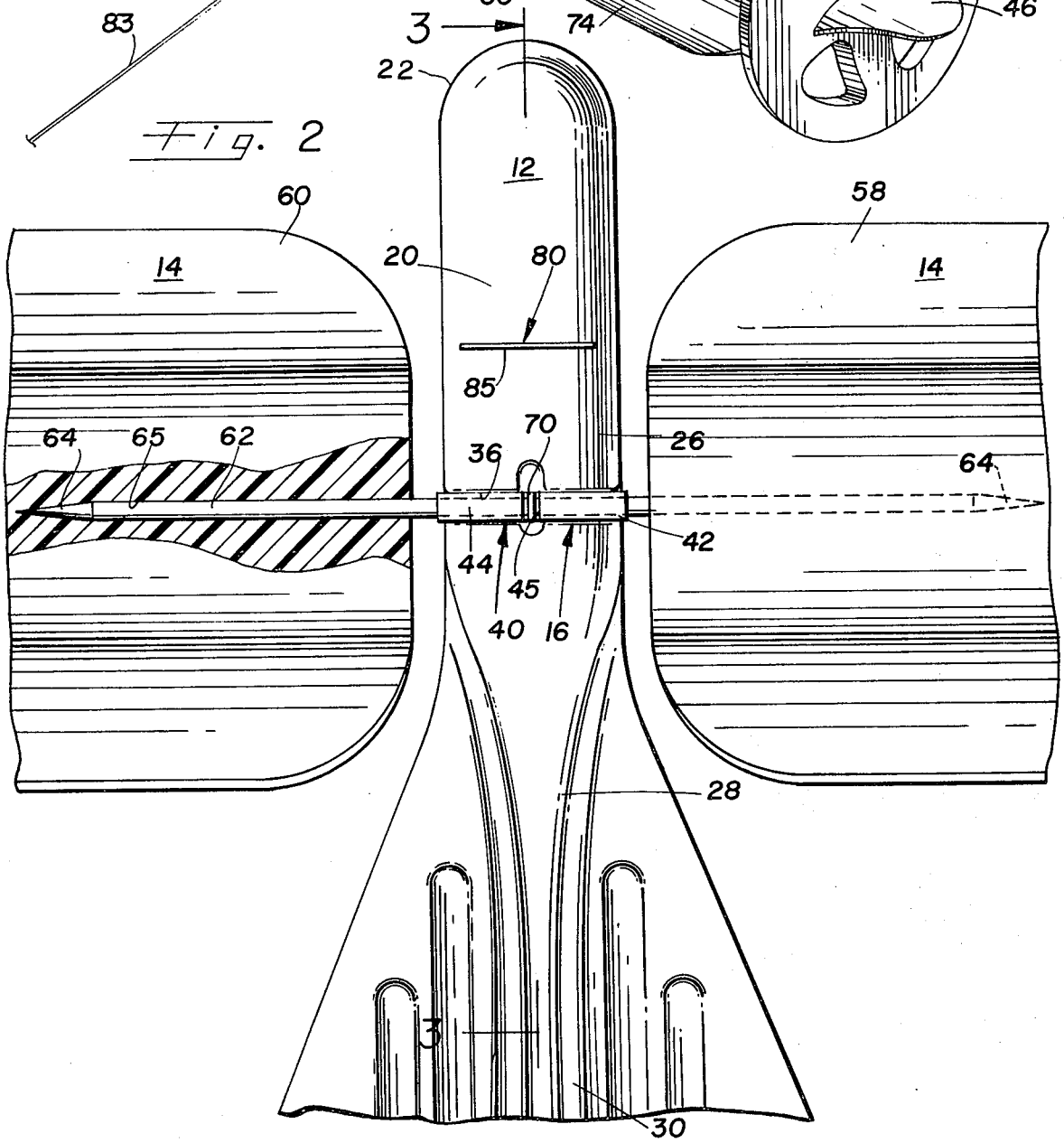
FIG. 2 is an enlarged, partial, top-plan view thereof with a portion of one wing broken away, showing the wing-support shaft fixedly received in said wing member.

Referring now to the wing means 14, said means comprises a pair of wing members 58 and 60, each being formed as a solid monolithic structure of the same material as that hereinbefore described for the fuselage. There is included within the wing means an elongated shaft 62 having oppositely-disposed free ends shaped to form a point 64. The pointed ends thereof are force-fitted into longitudinal bore 65 arranged in at least one end of each wing member, as seen in FIGS. 2 and 4, the diameter of the bore being slightly less than that of the outer diameter of the shaft 62. Thus, the shaft is force-fitted within the bore whereby the wing members will rotate with the shaft 62.

Before both wing members are attached to the shaft 62, said shaft is passed through bearing sleeves 42 and 44, and rotatably supported therein. In order to assure that the wing members are equally positioned on each side of the fuselage 12, there is provided a restraining means comprising a restraining ring 70. Said restraining ring 70 is easily accommodated within the slotted opening 45 between the bearing sleeves 42 and 44. Hence, if the shaft 62 is passed through sleeve 44, restraining ring 70 is then positioned to receive shaft 62, said ring being force-fitted over the shaft as the shaft is moved through the following sleeve 42, wherein the shaft is equally disposed so that each free end thereof is approximately the same distance from the retaining ring 70. At this point, both wing members are secured to the shaft wherein the shaft and wings are allowed to freely rotate within the bearing means, yet held from any transverse movement with respect to the fuselage body 12.

Means for stabilizing the kite in flight and also for providing landing and take-off means — while protecting the kite — is provided by disc-like members 72 of the circular form secured adjacent wing tips 74 of wing means 14. Each member 72 has a diameter which exceeds the width of wing means 14, so that leading and trailing edges 74 and 76, respectively, will not contact a ground surface. The disc-like members are also made of a similar plastic material to that of the fuselage and wings — thus, also, being provided with a sturdy, solid, lightweight construction.

Fuselage body 12 is also provided with a transverse slot 78, this slot being located forward the support means 16 and adapted to receive a tether-line-connecting means, generally indicated at 80. Said tether-connecting means comprises a thin sheet of plastic having a high tensile strength and being tear proof. It is formed in a substantially T-shaped configuration, as seen in FIG. 5. The vertical member 83 is arranged with a vertical aperture 84 that is exposed in recess 24 whereby a tether line 83, such as the typical kite string, can be easily attached thereto. The upper portion of the vertical member 82 terminates with an integral horizontal rib 85, thereby preventing the connecting means 80 from sliding through slot 78 when tension is applied to the tether line.

Thus, it is important to note that the kite 10 as described above may be readily packaged in knock-down form, and quickly assembled and disassembled, when necessary, without damaging the component parts thereof.

The invention and its attendant advantages will be understood from the foregoing description, and it will be apparent that various changes may be made in the form, construction and arrangement of parts of the invention without departing from the spirit and scope thereof or sacrificing its material advantages, the arrangement hereinbefore described being merely by way of example; and we do not wish to be restricted to the specific forms shown or uses mentioned, except as defined in the following claims.

We claim:

1. In combination with an airplane-like-kite toy having a fuselage wherein wing means are rotatable about a transverse axis thereon, the improvement comprising a support means demountably attached to said fuselage and whereby said rotatable wing means is supported thereon, and wherein said support means comprises:

bearing means adapted to receive said wing means for rotational movement therein, said bearing means being disposed transversely to the length of said fuselage;

means for detachably securing said support means to said fuselage.

wherein said bearing means and said detachable securing means are formed as an integral unit, and wherein the bearing means comprises a pair of bearing sleeves oppositely disposed and axially aligned with each other and having a slotted opening centrally interposed therebetween; and means for restraining said wing means from longitudinal movement relative to said bearing means.

2. The combination as recited in claim 1, wherein said wing means includes an elongated shaft rotatably supported in said bearing sleeves and held from longitudinal movement therein by said restraining means, and wherein said restraining means comprises a restraining ring adapted to be force-fitted about said shaft and positioned within said slotted opening between said bearing sleeves.

3. The combination as recited in claim 2, wherein said means for detachably securing said support means comprises:

a leg member integrally formed with said bearing sleeves and depending downwardly therefrom, wherein said fuselage is provided with a central slot to receive said leg member, with the free end thereof extending through said slot; and a locking plate formed to be removably locked to said leg member, whereby said support means is demountably secured to said fuselage.

4. The combination as recited in claim 3, wherein the depending leg member includes a pair of projecting fins disposed adjacent said free end of said leg member, whereby said locking plate is interdisposed between said fuselage and said projecting fins.

5. The combination as recited in claim 4, wherein a tether-line-connecting means is included therein and adapted to be mounted to said fuselage, said means comprising a thin sheet of plastic formed in a substantially T-shaped configuration having a horizontal rib member and a vertical member, said vertical member being provided with an aperture whereby a tether line is permitted to be secured thereto.

6. An airplane-like-kite toy comprising:

a solid monolithic body defining a fuselage of lightweight plastic material having a transverse channel disposed in the top of said body, and a longitudinal slot communicating with said channel and extending downwardly through the body;

a yoke member detachably mounted to said fuselage, and received in said channel and said longitudinal slot, wherein said yoke member comprises:

a pair of bearing-sleeve members oppositely disposed and axially aligned with each other and integrally formed, and having a slotted opening centrally interposed therebetween;

a leg member integrally formed with said bearing sleeves and depending downwardly therefrom, said leg being received in said longitudinal slot in said body and having a free end thereof extending outwardly from the bottom of said fuselage; and wherein a locking plate is provided to be removably locked to said leg member, whereby said support means is demountably secured to said fuselage; and wing means operably supported by said yoke member, said wing means comprising:

a pair of solid monolithic wing members;

a shaft having each of said wing members fixedly supported to opposite ends thereof;

means for restraining said wing means from longitudinal movement relative to said fuselage body; and means for detachably securing said yoke member to said body.

7. An airplane-like-kite toy as recited in claim 6, wherein said restraining means comprises a restraining ring adapted to be force-fitted about said shaft and positioned within said slotted opening between said bearing sleeves, thereby restricting longitudinal movement of said wing means.

8. An airplane-like-kite toy as recited in claim 7, including a removable tether-line-connecting means, said connecting means being supported in said fuselage forward the yoke member and wing means.

* * * * *